US007395855B2

(12) United States Patent
Ayling

(10) Patent No.: US 7,395,855 B2
(45) Date of Patent: Jul. 8, 2008

(54) RADIALLY MOVING SLIPS

(75) Inventor: Laurence John Ayling, Camberley (GB)

(73) Assignee: Coupler Developments Limited, Douglas, Isle of Mann (GB)

( * ) Notice: Subject to any disclaimer, the term of this patent is extended or adjusted under 35 U.S.C. 154(b) by 192 days.

(21) Appl. No.: 10/510,316

(22) PCT Filed: Apr. 1, 2003

(86) PCT No.: PCT/GB03/01410

§ 371 (c)(1),
(2), (4) Date: Oct. 2, 2004

(87) PCT Pub. No.: WO03/087528

PCT Pub. Date: Oct. 23, 2003

(65) Prior Publication Data

US 2005/0224260 A1 Oct. 13, 2005

(30) Foreign Application Priority Data

Apr. 5, 2002 (GB) ..... 0207908.5

(51) Int. Cl.
*E21B 19/10* (2006.01)

(52) U.S. Cl. ..... 166/77.52; 166/75.14; 175/423; 188/67; 81/57.18

(58) Field of Classification Search ..... 166/77.52, 166/75.14, 380; 175/423; 188/67; 81/57.18; 279/4.06–4.08
See application file for complete search history.

(56) References Cited

U.S. PATENT DOCUMENTS 935,764 A * 10/1909 Martin ..... 188/67
1,971,473 A * 8/1934 Zerbe et al. ..... 175/423
3,760,469 A 9/1973 Brown
4,576,254 A 3/1986 Cox ..... 188/67
4,715,456 A * 12/1987 Poe et al. ..... 175/423
5,027,926 A 7/1991 Cox ..... 188/67
6,089,338 A 7/2000 Bouligny ..... 175/423
6,644,413 B2 * 11/2003 Adams et al. ..... 166/77.1
6,688,394 B1 * 2/2004 Ayling ..... 166/380

* cited by examiner

*Primary Examiner*—Richard E. Chilcot, Jr.
*Assistant Examiner*—Matt J Smith
(74) *Attorney, Agent, or Firm*—Bartlett & Sherer; Ronald B. Sherer; Gerow D. Brill

(57) ABSTRACT

Slips (1, 21, 41) for engaging any jointed, coiled or flexible tubular with substantially no scoring, gouging or scraping, such as when supporting a drill string in a borehole or gripping a tubular (2, 22) during the connection or disconnection of a tool joint or pulling a cable or pipeline; additionally, applying a pre-determined minimum gripping force in order to avoid rotary slippage when the weight of the string is insufficient to achieve a conventional slips action; additionally, including a coarse wedge (30, 50) to take up the extra travel of a worn tool joint or a tubular of smaller diameter, with a means to ensure that the coarse wedge acts before the fine wedge (29, 49) does and a means to ensure that the wedging action remains if the actuating force is removed; additionally, including a secondary slips (40) to interfere with the upset on the tool joint to avoid relying on friction to support the string and a means of integrating this with the gripping slips and ensuring that the secondary slips act first; additionally, the application of these attributes 'upside down' to achieve the action of snubbing when forcing a tubular into compression instead of tension for any reason.

20 Claims, 8 Drawing Sheets

$X_1$ = HORIZONTAL DISTANCE
$X_2$ = VERTICAL DISTANCE $X_2$ LESS THAN $X_1$
BY A FACTOR OF 3

$Y_1$ = HORIZONTAL DISTANCE
$Y_2$ = VERTICAL DISTANCE $Y_2$ GREATER THAN $Y_1$
BY GREATER THAN 1.6 TIMES

RADIALLY MOVING SLIPS

The present invention relates to improved slips for use in drilling.

When drilling with jointed drill pipe, the drill string (string of connected drill pipes), within the well bore has to be supported at the level of the drill floor to allow the Top Drive, or Kelly, to be disconnected from it whenever a tubular is being added or removed from the drill string.

Conventionally this is achieved by 'setting the string in the slips'. The slips are wedges that are placed around the drill string and sit in, or are wedged into, the conical shaped bowl of the rotary bushings contained in the rotary table located in the drill floor, around the centre line of the well bore.

The gripping action of the slips is mainly caused by the weight of the drill string dragging the slips further into the bowl. Drill pipe slip assemblies are designed to allow supporting of an oil well drill string at virtually any location along the length of the drill string. In this way, the drill pipe and suspended weight can be repeatedly moved up or down and secured structurally to the drill floor as needed during drilling operations. The slip assemblies are typically composed of a "bowl" which is located in the rotary table that includes a tapered bore. The tapered bore is such that the bowl is smaller in diameter at the bottom than the top. Within the tapered bore, a plurality (typically three) of long circumferential gripping assembly segments are located, which are formed with an outer taper that matches the tapered bore of the bowl. These slip segments are interconnected by hinges so that the segments maintain a consistent axial relation to one another and may be simply opened and lifted away from the pipe either mechanically or by rig workers when not needed.

The slip segments with gripping assemblies, when installed in the slips bowl, form a cylindrical hole in the centre that is roughly the same size as the drill pipe body. The slips segments with gripping assemblies are either mechanically or manually lowered into the annular area between the bowl and the drill string when it is desired to suspend the drill string. The assembly naturally grips onto the pipe as it is wedged in the annular taper angle formed between the bowl and the slip segments.

Within each circumferential slip segment, multiple hardened "dies" are located for contact with the drill pipe surface. In one known example, there are three axial rows of six dies for a total of 18 hardened dies secured within each slip segment. These hardened dies typically include "tooth" profiles on the pipe interface surface that enhance the gripping capability of the dies on the pipe by actually penetrating the pipe surface slightly. The hardened dies are necessary because the contact stresses with the pipe can be quite high and the dies are subject to considerable wear. The gripping force that prevents axial, or rotational, motion of the drill string is thereby achieved more by indenting the surface, rather than by simple friction.

In normal operations the greater the weight of drill string being supported in the slips, the greater the gripping force. The gripping force is relieved by raising the drill string.

Sometimes it is required that the slips transfer torque to the drill string from the rotary table and this requires an adequate gripping force between the slips and the drill string. If there is inadequate weight of drill string to create the required gripping force it may be necessary to impose some downward force on the slips, for example hydraulically.

As the oil industry seeks to drill in ever-deeper offshore waters, the length and weight of the longest drill strings in service have increased accordingly, as well as the weight of the suspended loads such as casing strings and liners. This increases the penetration of the slips teeth into the pipe surface.

As the tubular string is lowered to wedge the slips, the teeth of the inserts are dragged downwards and it is difficult not to scratch, scrape or gouge the surface of the tubular. Similarly, when raising the tubular to disengage the slips, scratching of the tubular surface can take place. Additionally, when torque is required, either to turn the drill string, or to prevent it turning, if there is insufficient gripping then circumferential scoring can occur on the tubular surface.

All such marking of the tubular surface produces sites that are vulnerable to corrosion and it also initiates cracking and stress fractures. This is particularly serious at the locations where the drill string is typically supported, since these are the highest stress areas of the tubular, just off the upset of the tool joint, when being bent in curved well bores.

We have now devised slips which reduces or removes the movement of the teeth across the surface by enabling the teeth to approach or withdraw from, the surface of the tubular, at about 90 degrees to the axis of the tubular.

According to the invention there is provided slips comprising:

(i) a slips bowl seatable in a table (ii) a plurality of pipe-gripping slips disposed in the slips bowl for radial movement therein (iii) a moving means for moving the slips radially whereby movement of the slips into or out of contact of a tubular located within said bowl is at about substantially ninety degrees to the tubular.

By about ninety degrees to the tubular is meant that the movement of the slips is initially and substantially directly away from the tubular. When disengaging the tubular it does not have to disengage at exactly ninety degrees so long as the teeth of the slips disengage the tubular with substantially no dragging of the teeth across the tubular. This is reversed on engaging the tubular.

In existing slips the radial movement of the slips only takes place with vertical movement of the slips and it is this vertical movement of the slips which causes the scoring or marking of the surface of the tubular referred to above. With the slips of the present invention, the initial radial movement of the slips away from a tubular gripped by the slips is carried out without any or with substantially no vertical movement of the slips, so the teeth of the slips are not dragged across the surface of the tubular. Correspondingly when a tubular is to be gripped by the slips the last movement of the slips, when the slips contact the tubular, is also carried out with substantially no vertical movement of the slips.

The moving means preferably comprises a wedge which contacts a sloping external surface of the slips i.e. the surface of the slips which does not contact the tubular, whereby moving the wedge over the said sloping surface causes radial movement of the slips. The wedge is moved by a wedge moving means, such as an hydraulic ram which acts on the wedge to move it over the surface of the slips.

In order to constrain the movement of the slips into or out of contact with the tubular, so that this movement is at about substantially ninety degrees to the tubular, there is preferably a link, with one end pivotally attached to the slips and the other end pivotably fixed, whereby the slips are substantially constrained by the link to move substantially at ninety degrees to the tubular at the moment of contacting or retracting from the tubular.

The present invention can be applied to a wider range of diameters by having a plurality of wedges with each slip, for example by adding a coarse wedge behind each slip such that the majority of the travel can be taken up by the coarse wedge before the slips are themselves wedged and such capability is, for example, necessary to adjust to worn tool joints and to a variety of diameters of drill strings, tubulars or tool joints. The slips can be made fail safe on loss of applied external force by adding ridges to the coarse wedge, such that no acting friction slope within the slips assembly is at more than 1 in 6 (about 10 degrees) to the axis of the drill string, which is conventionally recognised to remain wedged until un-wedged by an externally applied force. Between the coarse wedge and the wedge moving means there is a fine wedge. By coarse wedge and fine wedge is meant that the angle of slope of the coarse wedge is greater than that of the fine wedge.

The slips bowl can be any conventional slips bowl and the bowl can be mounted in the rotary bushings or rotary table in the conventional way. If the slips are to rotate, a tubular held by the slips in the bowl can be rotated by the table.

The present invention can be applied where the conventional wedge shaped bowl is itself segmented and contained within an upside-down wedge shaped or conical bowl such that the movement of the inner segmented bowl, within the outer wedge shaped or conical bowl, allows the slips to accommodate an even greater range of diameters of drill strings, tubulars and tool joints.

There can be a second set of slips that interfere with the shoulder of the tool joint such that, once applied or set, the support of the drill string weight does not rely on friction, or indentation of the surface of the drill string, tubular or tool joint. This embodiment allows the gripping of the drill string, tubular or tool joint solely to be required to provide or resist torque, while the axial force is taken by the said second set of slips.

The slips bowl is a wedge shaped bowl into which the slips are wedged and in the present invention the bowl moves axially, in parallel with the drill string axis, while the drill string, tubular or tool joint remains static and the slips are forced into contact with the said drill string, tubular or tool joint with little or no relative motion in the direction of the axis of the drill string.

The wedge shaped bowl and slips can be forced together by a known hydraulic pneumatic, mechanical or electrical force so that the minimum gripping force between the slips and the drill string, tubular or tool joint can be predetermined and the gripping force does not rely on the weight of the drill string to drag the slips into the bowl.

In this invention no motion of the drill string is required to achieve a minimum gripping force between the slips and the drill string, tubular or tool joint.

Any relative motion between the slips and the drill string, tubular or tool joint, parallel to the axis of the drill string, is so limited that scratching, scoring or gouging of the surface of the drill string, tubular or tool joins is minimised or avoided.

The present invention can be applied to the supporting or gripping or restraining of pipes, drill pipes, drill strings, tubulars, tool joints, casings, or any assembly of tubular components, during their connection or disconnection or rotation or raising or lowering or assembly or dis-assembly, whether hanging within the well bore or outside the well bore, at any angle of inclination to the vertical. It can be applied to all drilling and workover rigs, in which it is required to support and/or grip the tubulars being inserted or withdrawn from the well bore, usually in the vicinity of the rotary table.

The slips of the present invention can also be used in snubbing. Whenever a tubular has to be forced down into the well bore against the wellhead pressure, which could be as much as 5,000 psi, or more, the action is called snubbing.

A suitable method to achieve snubbing is to grip the tubular with a mechanism similar to an upside down slip. In this case, also, it is valuable to ensure that the slips do not scratch, score or gouge the surface of the tubular. The present invention similarly achieves the desired relative motion between the slips and the tubular at the moment that the slips impinges on, or retracts from, the tubular surface. The slips can be applied upside down to achieve the snubbing of a tubular from one environment, into another at a higher pressure, such as from atmospheric pressure into a well bore under a higher pressure, or where the drill string is being forced out of the well bore instead of hanging within it usually above and on the axis of the rotary table.

It is a feature of the invention that it achieves a more positive and safer axial and/or torsional gripping and/or supporting of tubulars than is conventionally achieved, while avoiding damage to the tubular surfaces other than simple indentation.

As well as being used with tubulars the invention can be used in any application where rigid, coiled or flexible tubular components are to be gripped with minimum damage to their surface such as, for example, in pipe line or cable, laying or pulling, etc.

The invention is illustrated in the accompanying drawings in which.

Figure 1:
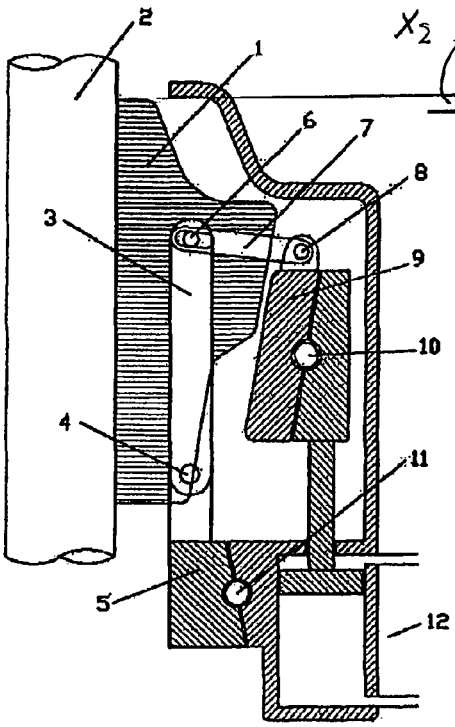
FIGS. 1 and 2 illustrates the application of the new slips motion to the rotary slips mounted in a drill floor and taking up minimum horizontal space.
Figure 2:
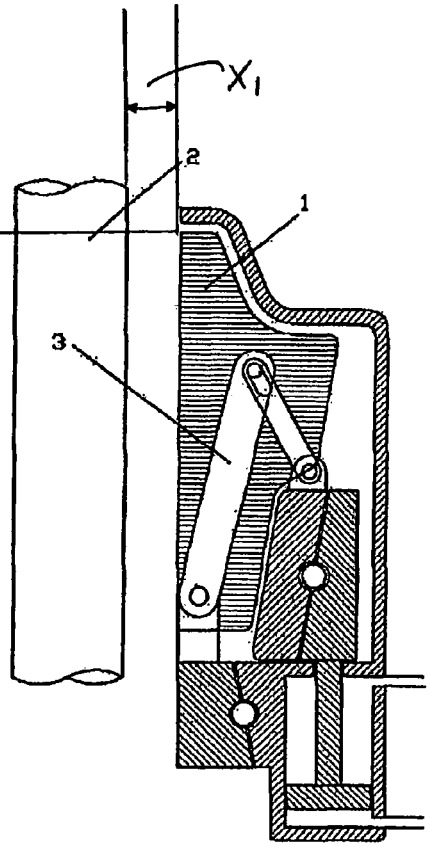
Figure 8:
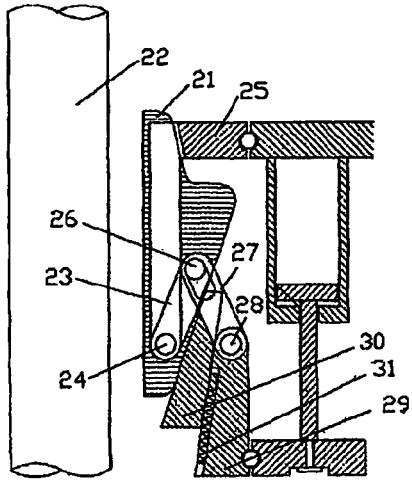
Figure 9:
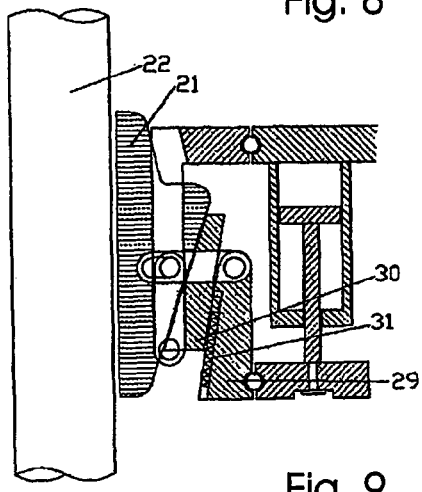
Figure 10:
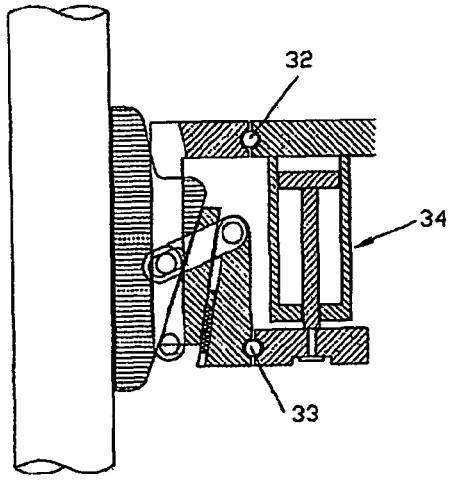

FIGS. 8 to 10 show the use of a double wedge to accommodate tubulars of a wide range of diameters FIGS. 11 to 14 illustrate an embodiment in which the sliding of the slips is constrained and FIGS. 15 to 18 illustrate the use of second slips Referring to FIGS. 1 and 2, the tubular (2) is held by slip (1) (FIG. 1), the slip (1) is held against the tubular (2) by wedge (9). There is a link (3) pivotably connected to the slip (1) by pin (6); the other end of the link (3) is supported by pin (4) held by structure (5). There is link (7) also connected to pin (6) and connected to the wedge (9) via pin (8). The wedge (9) and structure (5) are both supported in bearings (10) and (11) to allow rotation, the wedge (9) is supported in the hydraulic ram arrangement (12).

In use to engage slips and go from the position of FIG. 2 to the position of FIG. 1, the hydraulic ram arrangement (12) moves wedge (9) upwards and acts on slips (1). The movement of the wedge (9) vertically over the slips (1), which do not substantially move vertically, forces the slips (1) to move inwards. Existing slips have to move vertically in order to move into the stationery wedge. In existing slips this vertical motion of the slips is achieved in one of two ways: In manually placed slips, the tubular is lowered so that the surface of the tubular catches on the teeth of the inserts and drags the slips into the wedge, thus producing 'upward' scoring of the tubular. If, however, there is a mechanical actuator, the tubular remains supported by the Top drive or Kelly, while the slips are forced downwards into the wedge and thereby produce downward scoring of the tubular. In the present invention the function of link (3) constrains the slips (1) to move substantially horizontally i.e. substantially perpendicular or ninety degrees to the tubular (2) and so would not act to score or scratch the surface of tubular (2).

Figure 3:
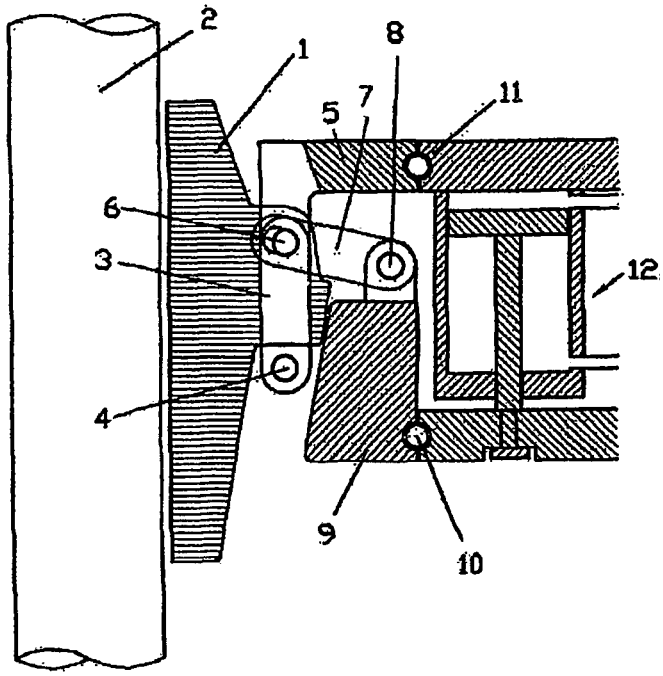
FIGS. 3 and 4 illustrate the same application as in FIG. 1 while taking up minimum vertical space
Figure 4:
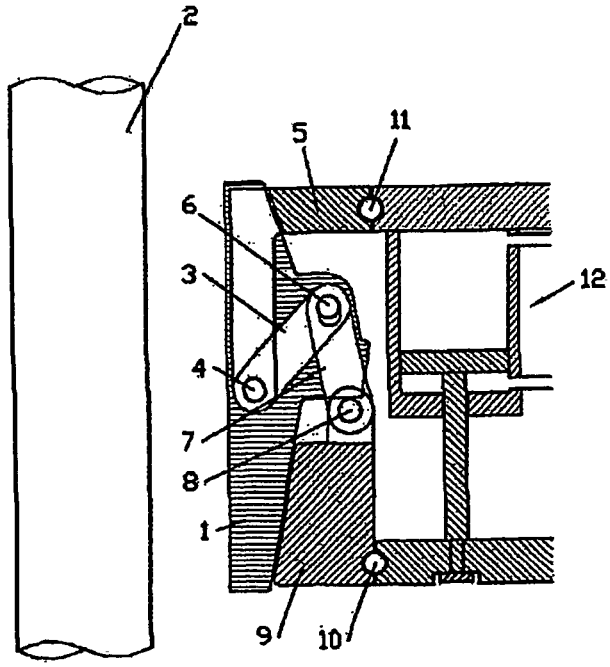

Referring to FIGS. 3 and 4, the tubular (2) is held by slip (1) (FIG. 3), the slip (1) is held against the tubular (2) by wedge (9). There is a link (3) pivotably connected to the slip (1) by pin (6); the other end of the link (3) is supported by pin (4) held by structure (5). There is link (7) also connected to pin (6) and connected to the wedge (9) via pin (8). The wedge (9) and structure (5) are both supported in bearings (10) and (11) to allow rotation, the wedge (9) is supported by the lower end of the hydraulic ram arrangement (12).

In use to engage slips and go from the position of FIG. 4 to the position of FIG. 3 the hydraulic ram arrangement (12) moves wedge (9) upwards to act on slips (1). The link (3) constrains the slips (1) to move substantially horizontally i.e. substantially perpendicular to the tubular (2) and so would not act to score or scratch the surface of tubular (2).

Figure 5:
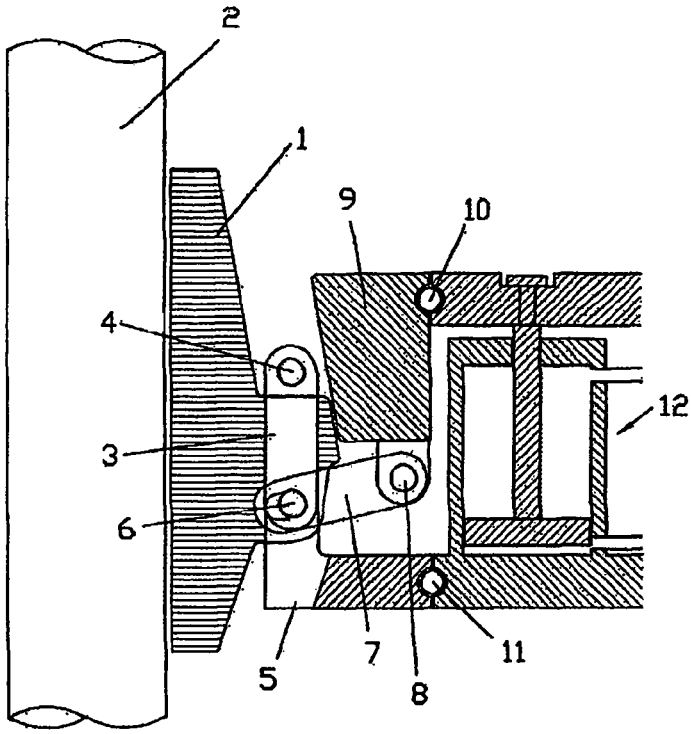
FIGS. 5 and 6 illustrates the application of the new slips to snubbing
Figure 6:
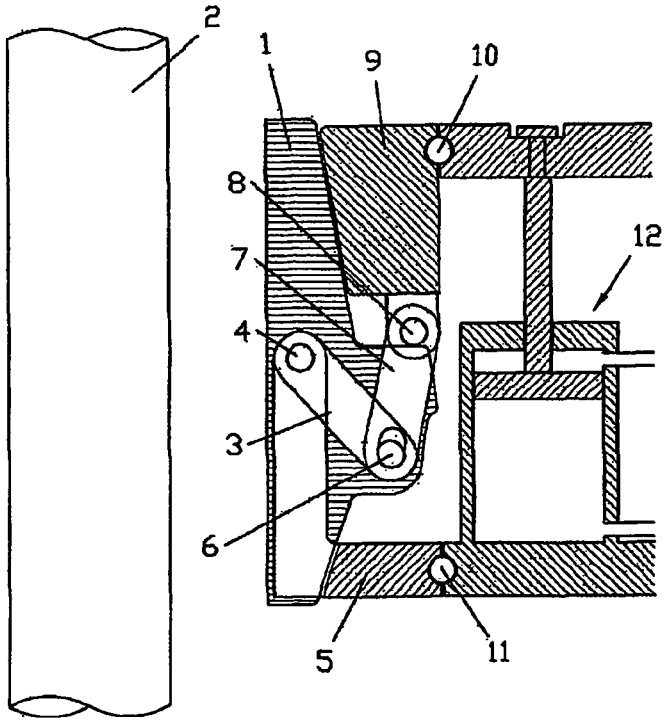

Referring to FIGS. 5 and 6 the tubular (2) is held by slip (1) (FIG. 5), the slip (1) is held against the tubular (2) by wedge (9). There is a link (3) pivotably connected to the slip (1) by pin (6); the other end of the link (3) is supported by pin (4) held by structure (5). There is link (7) also connected to pin (6) and connected to the wedge (9) via pin (8). The wedge (9) and structure (5) are both supported in bearings (10) and (11) to allow rotation, the wedge (9) is supported by the lower end of the hydraulic ram arrangement (12).

In use to engage slips and go from the position of FIG. 6 to the position of FIG. 5 the hydraulic ram arrangement (12) moves wedge (9) downwards to act on slips (1). The link (3) constrains the slips (1) to move substantially horizontally i.e. substantially perpendicular to the tubular (2) and so would not act to score or scratch the surface of tubular (2).

Figure 7:
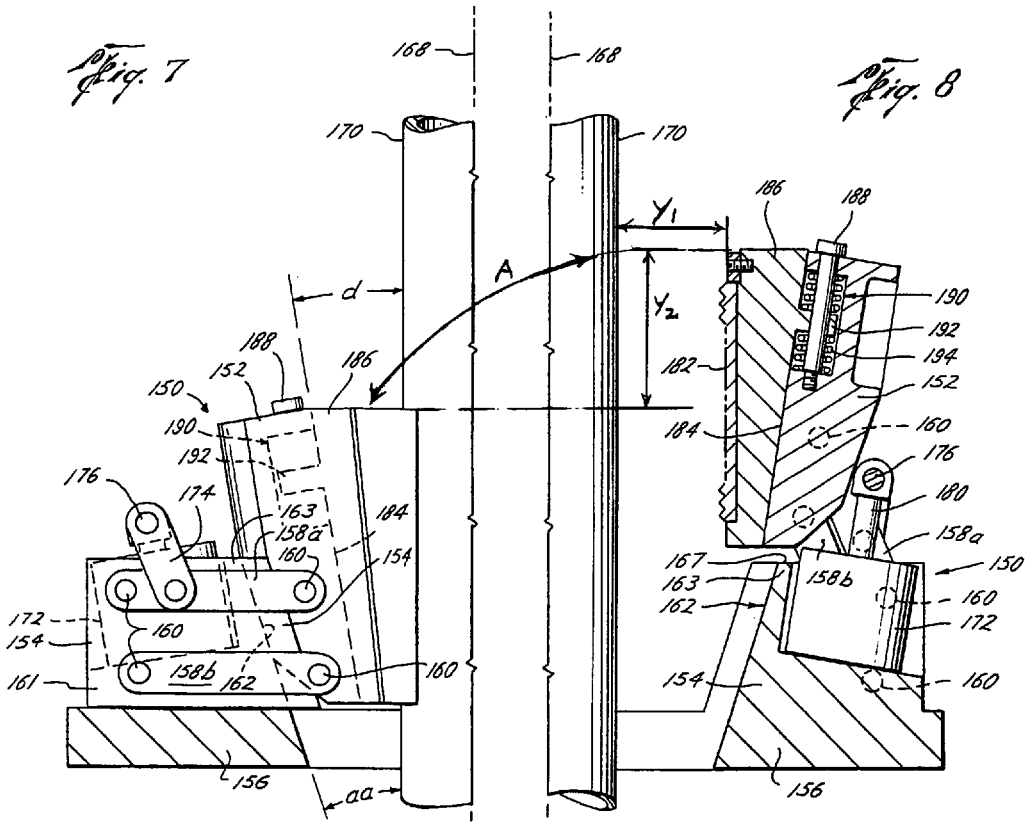
FIG. 7 shows an exploded view of an actuating mechanism of the slips of FIG. 5

Referring to FIG. 7 this shows how the components used in FIG. 5 are assembled.

Referring to FIGS. 8 to 10, the link (23) is pivotably connected to the slip (21) by pin (26); the other end of the link (23) is supported by pin (24) held by structure (25). There is link (27) also connected to pin (26) and connected to the wedge (29) via pin (28). The wedge (29) is supported by the lower end of the hydraulic ram arrangement (34). In use the slip moves from the position of FIG. 8 to the position of FIG. 10 where the slips (21) engage the tubular (22). The slips (21) is extended and forced against the tubular (22) by the two wedges (29 & 30). The wedge (30) is a coarse wedge i.e. the angle of slope of the wedge is larger than that of the fine wedge (29).

There is a spring (31) between the wedges (29) and (30). The majority of the movement of the slip (21) towards the tubular (22), from FIG. 8 to FIG. 9, is caused by the simultaneous movement of both wedges (29 & 30) by the action of the hydraulic ram (34) on wedge (29). Once the slip (21) has contacted the tubular (22), only the fine wedge (29) continues to move upwards, as in FIG. 9 to FIG. 10, until the necessary gripping force is applied to the tubular (22). The linkages in FIGS. 8 to 10 act in the same way as in FIGS. 1 & 2. The slip (21) is constrained by the new link (23) to impact on the tubular (22) at approximately 90° to the surface of the tubular (22).

The vertical motion of wedge (29) and the introduction of the new link (23) to constrain the slip (21) to move horizontally, or near horizontally, when slip (21) is in contact with tubular (22) are novel.

The link (27) has a slotted end around pin (26) so that the slip (21) in FIG. 9 is free to move towards the tubular but this link (27) can withdraw the slip away from the tubular as shown in FIG. 8.

The inclusion of spring (31) is preferred in order to ensure that no slippage between course wedge (30) and the fine wedge (29) takes place until the slip (21) has reached tubular (22). Thereafter, the fine wedge (29) provides the necessary gripping force between the slip (21) and the tubular (22).

The slope of the surface between a conventional slip and the wedge shaped bowl behind it is at an angle of some 10 degrees to the axis of the tubular or, more usually, a gradient of 1 in 6. This can be a suitable gradient of the slope of the wedge (9) in FIGS. 1 to 6 and/or the fine wedge (29) in FIGS. 8 to 10. However in FIGS. 8 to 10, the slope of the surface between the slip (21) and the coarse wedge (30) can be at a gradient of 1 in 3 or steeper, compared to the axis of the tubular (22).

In FIGS. 8 to 10, the gripping force is dependant on the application of an applied force as shown, for example, by the hydraulic ram system (34).

It is known by experience that, in the general application of slips, a 1 in 6 gradient will remain wedged but a 1 in 3 gradient, or more, will not remain wedged.

Figure 11:
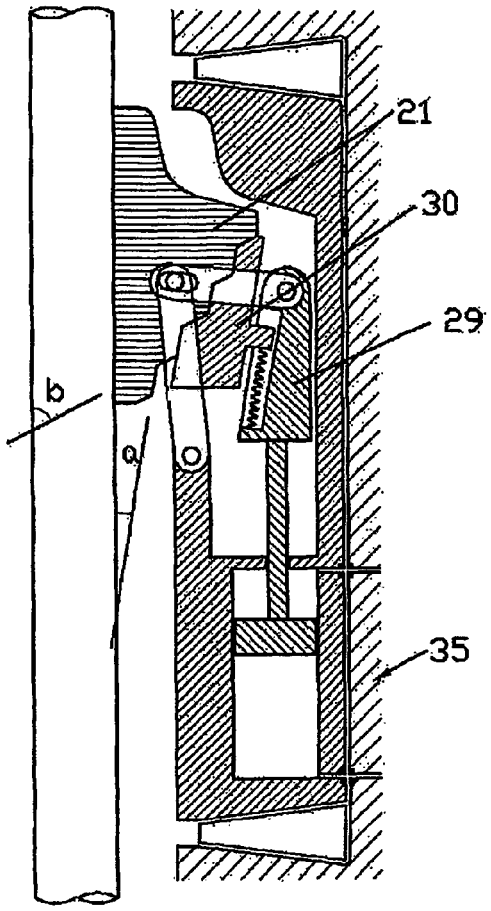

It may be required to apply a 'fail safe' gripping force, such that it will continue despite a failure of the hydraulic ram system (34). It is therefore preferred that the surface of the slip (21) and the surface of the course wedge (30) are not flat but formed of a plurality of ridges as shown in FIG. 11. Preferably, each ridge is formed of two gradients, one at 1 in 6 to the vertical (angle a) and one at a higher gradient such as 1 in 2 (angle b). When the fine wedge (29) is applied, the course wedge (30) would slip back down the 1 in 2 surfaces until the 1 in 6 surfaces were in contact, at which point slipping would stop, even if the applied force, such as the hydraulic ram (35) was removed. It would thereby allow the mechanism of FIGS. 8 to 10 to operate in a fail safe manner without any externally applied force, once the wedges were wedged.

In FIGS. 8 to 10, the slips are shown as capable of being rotated about the axis of the tubular (22), wherein the wedge (29) and structure (25) are both supported in bearings (32) and (33), which are themselves supported in the hydraulic ram arrangement (34).

By such means, in FIGS. 8 to 10, the slips may rotate, as well as support, the drill string but the protrusions on the slips inserts should never scratch, score or gouge the surface of the tubular, a minimum gripping force can be applied to the tubular to apply the required torque even if there is inadequate weight of drill string to wedge the slips, and a wider range of diameters of the tubular bodies or tool joints can be accommodated.

Conventionally, the slip is usually one of three slips placed around the tubular. In this invention 3 or more are preferred. However, in the configuration shown in FIGS. 8 to 10, which caters for a range of diameters, it is preferred that there are a larger number of thinner slips, perhaps 5 or more, so that the slips can better contact a range of tubular curvatures.

There would be the same number of course wedges (30) as the number of slips (21). The fine wedges (29), though, whilst also being of the same number as the course wedges (30), would each form part of a continuous ring or cylinder around the course wedges, slips and the tubular and thereby contain the forces produced by wedging the slips against the tubular.

Figure 12:
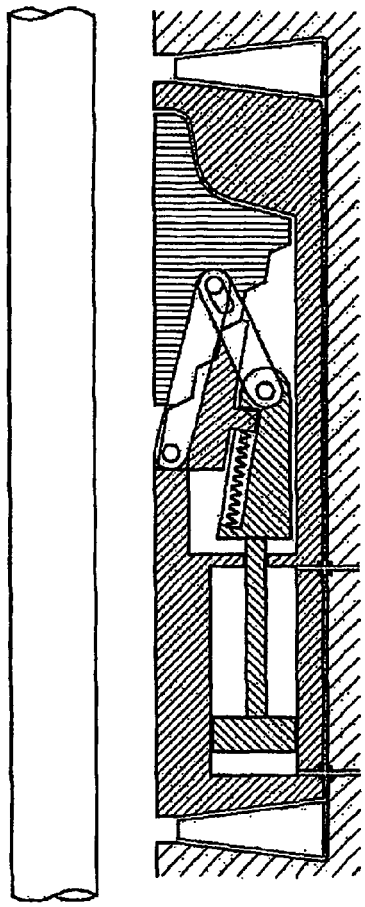
Figure 13:
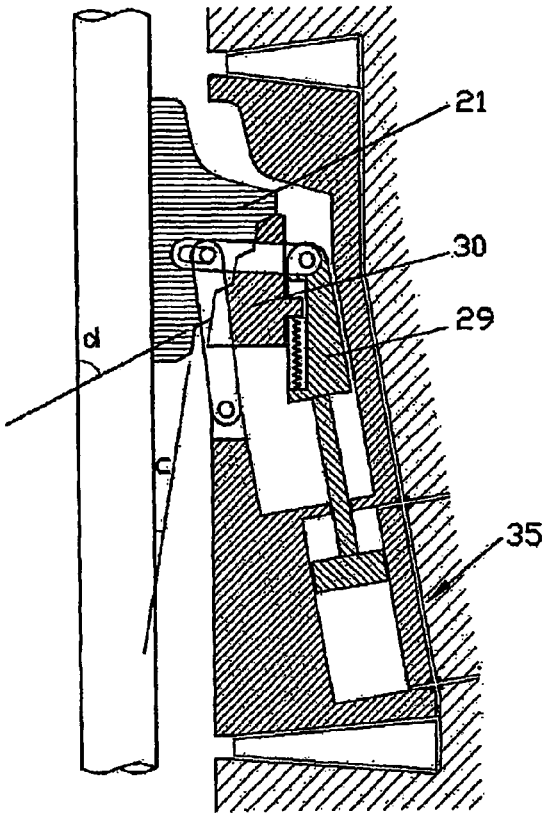
Figure 14:
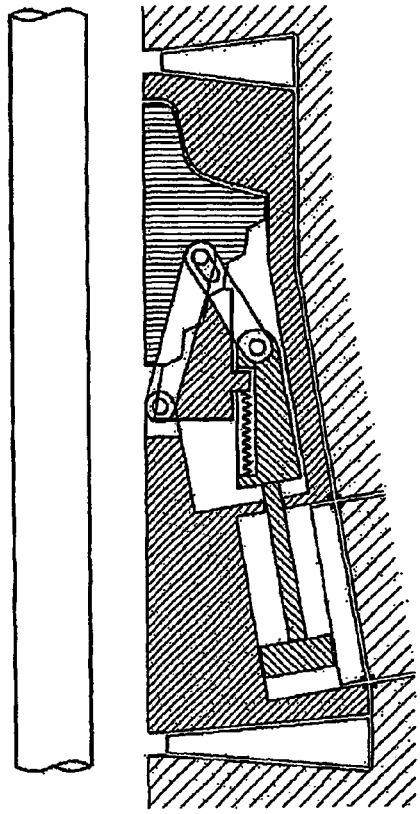

An alternative method is shown in FIGS. 11 and 12, whereby the fine wedges (29) are not connected to each other but are constrained to slide within a cylinder with vertical sides (35), which itself applies the circumferential tension. A further option is for this cylinder to have conical inside walls (35) to contribute to the inward movement of the slips (21) as the wedge or wedges (29) and (30) moved upwards as shown in FIGS. 13 and 14.

In FIGS. 15 to 18, a further aspect of this invention is the addition of a second set of slips (40), which can be introduced to provide a more safe and positive support of the drill string without relying on friction. This added set of slips is positioned between the shoulder of the tool joint and a conical surface in the surrounding body so that, once placed, it is impossible for the drill string to fall down the well bore.

Figure 15:
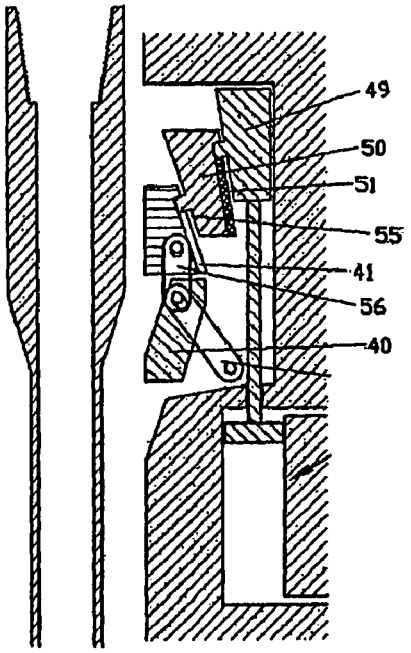

In FIG. 15 one of the set of additional slips (40) is shown retracted clear of the well bore, as is also the main slip (41). The main slip (41) is shown connected to the course wedge (50) by a key way (55). The course wedge (50) is connected to the fine wedge (49) by a keyway (51), which contains a spring in order to delay motion between the course wedge (50) and fine wedge (49).

The main slip (41) is connected to the additional slip (40) by the link (56) and the additional slip (40) is connected to the structure (45) by the link (57).

The whole mechanism is driven by a hydraulic ram (54), which acts directly on the fine wedge (49). The fine wedge (49) can be one of a plurality of fine wedges all forming part of a solid rig around the centre line of the well bore, or the fine wedges (49) can be one of a plurality of fine wedges that are not connected to each other but are constrained from moving away from the centre line of the well bore by the solid structure (45).

Figure 16:
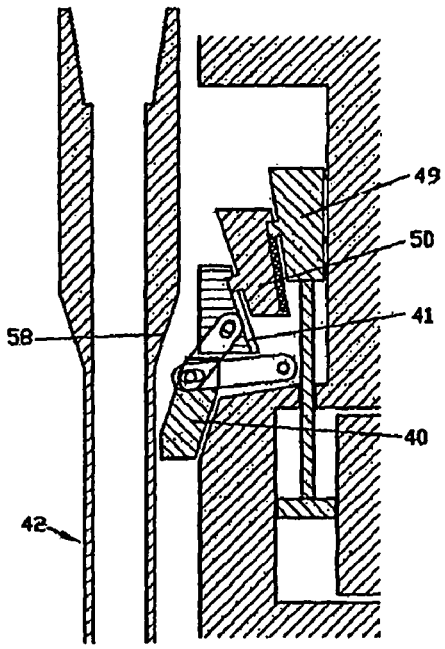

In FIG. 16 the additional slip (40) has been pushed into place by the downward motion of the fine wedge (49), course wedge (50) and main slip (41).

Figure 17:
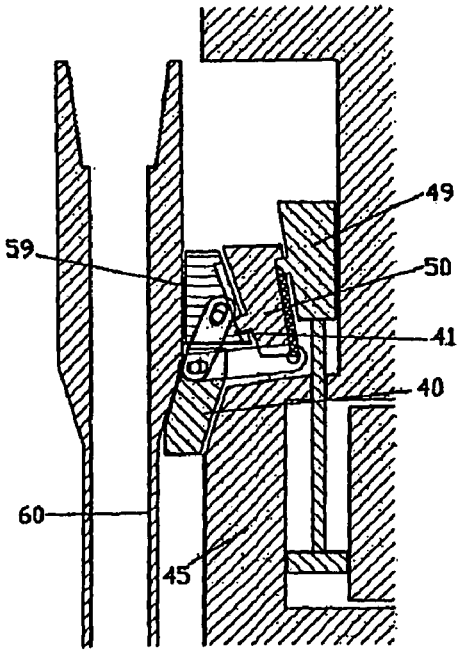

The drill string (42) can then be lowered until the shoulder (58) rests on the additional slip (40) as shown in FIG. 17. The main slip (41) is then pushed inwards and contacts the surface of the tool joint (59), moving perpendicular to the said surface. This motion is achieved by the course wedge (50) sliding against the main slip (41).

When the course slip (50) cannot slide any further, the fine slip (49) begins to slide against the course slip (50) and this motion tightens the gripping force of the main slip (41) against the surface of the tool joint (59).

The additional slip is one of a plurality of slips that encircle the tubular body (60). These slips come into contact with each other and form a strong continuous ring around the tubular body (60) but of a larger internal diameter than the external diameter of the tubular body (60), such that no force is applied to the tubular body (60) itself. These slips and the surrounding structure (45) provide a solid and failsafe support for the drill string (42) since the larger diameter of the tool joint surface (59) cannot pass.

Figure 18:
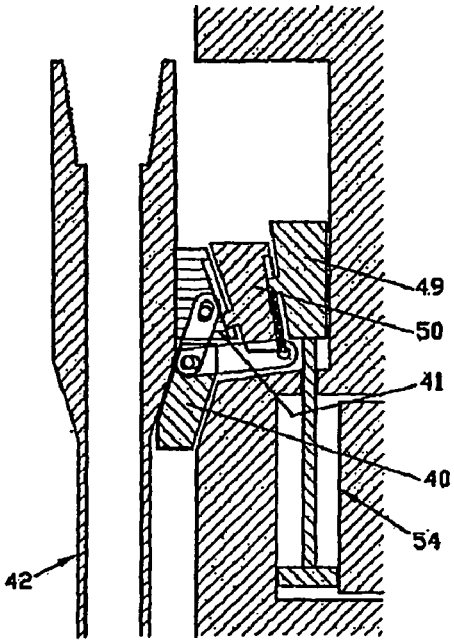

In FIG. 18, the supporting and gripping of the drill string (42) by the additional slips (40) and main slips (41), held in place by course wedge (50) and fine wedge (49) under the applied force of the hydraulic ram (54), provides a very compact and safe solution. The applied force can be hydraulic, mechanical or electrical and, if it is required to make the gripping action fail safe as well, then a stepped surface maybe used between the course wedge (50) and the main slip (41) as previously described in FIGS. 11 to 14. The mechanism would continue to grip the tool joint, without any applied force, until released by the raising of the fine wedge (49) by an applied force.

The arrangement shown in FIGS. 15 to 18 may also be used, upside down, in a snubbing operation as previously discussed.

The invention claimed is:

1. Slips for securing a drill string comprising:

(a) a plurality of tubular-gripping slips mounted for radial movement toward and away from the drill string;

(b) moving means for moving the slips radially whereby the moving means move the slips into or out of contact with the drill string at substantially ninety degrees to the drill string;

(c) said slips including sloping external surfaces and in which said moving means comprises wedges which contact said sloping surfaces thereby moving said wedges over said sloping surfaces causing radial movement of the slips; and (d) wedge moving means for applying a force to said wedges to move said wedges over said sloping surfaces of the slips.

2. The slips as claimed in claim 1 in which there are two sets of wedges between said wedge moving means and said slips, said first set of wedges being in contact with said sloping surfaces of the slips, and said second set of wedges being in contact with said first set of wedges.

3. The slips as claimed in claim 2 in which said first set of wedges are coarse wedges and said second set of wedges are fine wedges.

4. The slips as claimed in claim 3 including ridges on said coarse wedges such that said sloping surfaces are at an angle greater than about 10 degrees with respect to the axis of the drill string.

5. The slips as claimed in claim 2 including a spring located between said first and second sets of wedges.

6. The slips of claim 1 in which said moving means comprises first and second actuating links pivotally connected to each other.

7. The slips of claim 1 including spring means positioned between said wedge moving means and said wedge.

8. The slips of claim 1 wherein said slips are vertically positioned so as to engage a drill string having a tool joint, and further including additional slips positioned to engage the tool joint to provide failsafe support of the drill string.

9. The slips of claim 1 wherein said slips include a stepped surface.

10. The slips of claim 1 including bearing means for rotating said wedges about the vertical axis of the drill string.

11. The slips as claimed in claim 1 wherein said slips have surfaces for contacting and securing said drill string, and wherein said surfaces are non-ridged smooth surfaces for engaging and securing said drill string without damaging the outer surfaces of the tubular comprising said drill string.

12. A slips system for engaging and securing a drill string comprising a plurality of tubulars having tool joints, each tool joint including a vertically extending surface portion and a shoulder portion comprising:

(a) a first set of slips positioned for movement toward and away from said vertically extending surface portion;

(b) a second set of failsafe slips positioned for movement toward and away from said shoulder portion; and (c) power actuator means connected to said slips for moving said first set of slips into gripping engagement with said vertical surface portions of the tubulars and for moving said second set of slips into engagement with said shoulder portion.

13. The slips system of claim 12 wherein said system includes link means connected between said power actuator means and said first set of slips for moving said first set of slips into engagement with a substantially purely radial, horizontal movement whereby the tool joint is not scored.

14. A slip assembly for gripping a tubular having a longitudinal axis comprising:

(a) a plurality of tubular-gripping slips disposed about said tubular:

(b) a support;

(c) means mounted on said support for moving said slips radially into contact with, and away from, said tubular; and (d) a plurality of links each having one end pivotally mounted on one of said slips and the other end pivotally mounted on said support, the arrangement being such that, in use, said links constrain the vertical movement of said slips such that said slips move substantially purely radially and engage said tubular with a force substantially perpendicular to the longitudinal axis thereof.

15. A slips assembly as claimed in claim 14, wherein said one end of said link is pivotally mounted to said slip via a first pin wherein the other end of said link is pivotally mounted to said support by a second pivot pin, and a line drawn through said first pin and said second pin is substantially parallel to the longitudinal axis of said tubular when said slip engages said tubular.

16. A slip assembly as claimed in claim 14 in which the means comprises a wedge which, in use, contacts a sloping external surface of the slip whereby moving the wedge over the said sloping external surface causes radial movement of the slip towards the tubular.

17. A slip assembly as claimed in claim 14 in which the means comprises a first wedge and a second wedge wherein, in use, the first wedge contacts one side of the second wedge and the other side of the second wedge contacts a sloping external service of the slip whereby moving the first wedge causes radial movement of the slip towards the tubular.

18. A slip assembly as claimed in claim 17 further comprising a spring located between said first wedge and said second wedge.

19. A slip assembly as claimed in claim 17 wherein the first wedge is a coarse wedge and the second wedge is a fine wedge.

20. A slips assembly comprising:

(a) a plurality of tubular-gripping slips mounted for radial movement about a tubular;

(b) moving means for moving said slips in a substantially purely radial motion whereby said slips do not damage said tubular in engaging and vertically securing said tubular; and (c) wherein said slips assembly includes a sloping external surface on said slips, and in which said moving means includes wedge means which contact said sloping surface for moving said slips in a substantially purely horizontal plane.

* * * * *